US007434526B2

(12) United States Patent
Steen

(10) Patent No.: US 7,434,526 B2
(45) Date of Patent: Oct. 14, 2008

(54) DOUBLE SHELL TANK SHIP

(75) Inventor: Günter Steen, Kiel (DE)

(73) Assignee: Lindenau GmbH, Kiel-Friedrichsort (DE)

( * ) Notice: Subject to any disclaimer, the term of this patent is extended or adjusted under 35 U.S.C. 154(b) by 91 days.

(21) Appl. No.: 10/587,260

(22) PCT Filed: Aug. 22, 2005

(86) PCT No.: PCT/EP2005/009034

§ 371 (c)(1),
(2), (4) Date: Jul. 26, 2006

(87) PCT Pub. No.: WO2006/021394

PCT Pub. Date: Mar. 2, 2006

(65) Prior Publication Data

US 2007/0144422 A1 Jun. 28, 2007

(30) Foreign Application Priority Data

Aug. 26, 2004 (DE) ..... 10 2004 041 593

(51) Int. Cl.
*B63B 25/08* (2006.01)

(52) U.S. Cl. ..... 114/74 A

(58) Field of Classification Search ..... 114/74 A
See application file for complete search history.

(56) References Cited

U.S. PATENT DOCUMENTS

| | | | | |
|---|---|---|---|---|
| 3,844,239 | A | 10/1974 | McLaughlin et al. | |
| 3,941,272 | A * | 3/1976 | McLaughlin | 220/560.11 |
| 5,218,919 | A | 6/1993 | Krulikowski et al. | |
| 5,379,711 | A * | 1/1995 | Fischer et al. | 114/74 A |

FOREIGN PATENT DOCUMENTS

| | | |
|---|---|---|
| EP | 0 723 908 | 7/1996 |
| EP | 0 799 764 | 10/1997 |
| JP | 07 196074 | 8/1995 |
| WO | 00/35746 | 6/2000 |

* cited by examiner

*Primary Examiner*—Jesús D Sotelo
(74) *Attorney, Agent, or Firm*—Merek, Blackmon & Voorhees, LLC

(57) ABSTRACT

The invention relates to a double shell tank ship comprising an outer skin made of steel and an inner shell made of steel, which surrounds the individual holds spaced from the outer skin, wherein outer skin and inner shell are rigidly interconnected by means of vertically and horizontally extending elements. The connecting elements are provided with rated break points or perforations, and the inner shell has been made of a steel comprising high breaking elongation.

12 Claims, 4 Drawing Sheets

FIG. 4
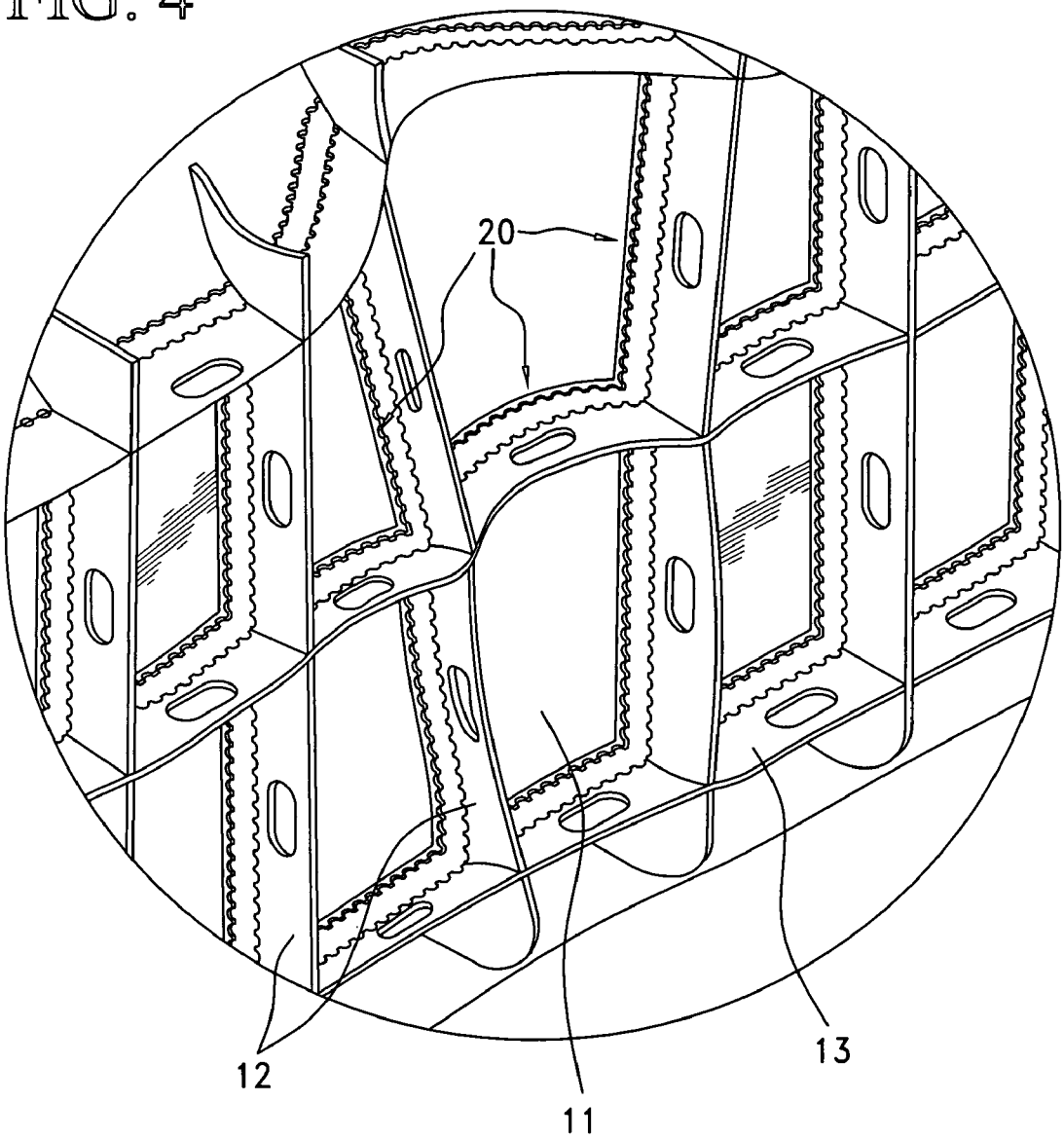
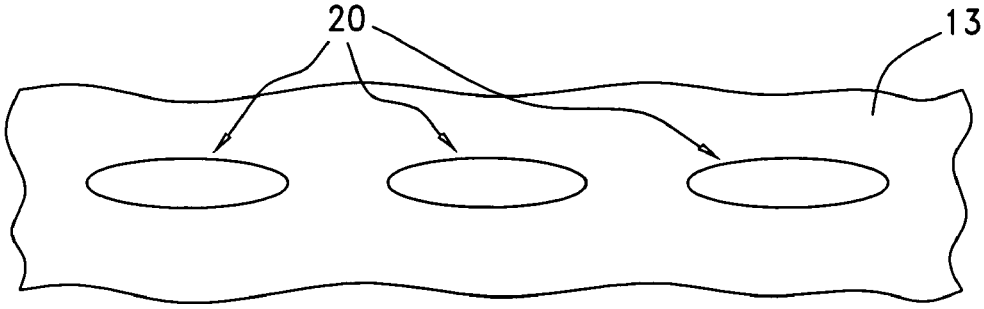
FIG. 5

DOUBLE SHELL TANK SHIP

CROSS-REFERENCE TO RELATED APPLICATION

The present application claims the priority under 35 U.S.C. 119 of German Application No. 10 2004 041 593.5, filed Aug. 26, 2004, which is hereby incorporated herein by reference in its entirety.

The invention relates to a double shell tank ship comprising an outer skin and an inner shell, which surrounds the individual holds distanced from the outer skin, wherein outer skin and inner shell are rigidly connected with each other by means of connecting elements.

There is the risk regarding double shell tank ships in case of average that not only the outer skin or the ship is destroyed, but also the inner shell. Only in case of smaller averages it may be expected that only the outer skin is destroyed, but not the inner shell. The normal case of a damage would possibly be, though, that by the destructive forces of a ramming vehicle, for example the bulbous bow thereof, the outer skin is damaged, aid the inner shell via the mounting elements between outer skin and inner shell is also deformed and springs leaks such that the cargo leaks out. In case of petroleum, this results in the sufficiently known disasters then.

The double shell tank ship of the type indicated above is characterised according to the invention in that the connecting elements, that is at least some of the vertical inner shell members of frame and/or at least some of the horizontal stringers, doe provided with rated break pointed or perforations, and the inner shell has been produced from a highly resilient steel with high breaking elongation.

The general idea embodied by the invention can be seen in that at least some, preferably all mounting and/or connecting elements between the outer skin and the inner shell comprise rated break points. Thus, in case of an average, forces can be exorted on the outer skin from the outside, and since the rated break points react in the direct area, where the forces act, mechanical connections to the inner shell are interrupted, these remain intact and the cargo cannot, discharge. In case of stronger collisions or forces acting at an unfavourable angle, the forces can also act on the inner shell, and since this, however, has been produced from a highly resilient steel with high breaking elongation, the inner shell can deform such that no cracks appear thereby. Only with very large forces the inner shell can be destroyed as well, which should only be the case in not more than 3% of the accidents known from statistics, though.

The principle of the present invention relies on the realisation that in many average cases the outer skin of a ship according to the invention is destroyed at locations, where this can be accepted, the inner shell is only deformed, though.

The present invention also offers a protection against leaking out of cargo, especially of petroleum, in almost 100% of the accidents known and evaluated so far.

In double shell tank ships the connecting elements between outer skin and inner shell are substantially the so-called stringers, the support elements belonging to the stringers and the vertically oriented members of frame. This is a honeycomb construction made of brace-like connections and sheet metal components in horizontal and vertical orientation attached at the braces.

According to the invention, the metal sheets are provided with rated break points by means of perforations or rows of holes, i.e. round holes or individual elongated holes with interruptions are designed in line form such that a perforation line is obtained.

The perforation line is preferably arranged more closely to the inner shell. It is also conceivable, however, to mount this perforation or rated break line closer to the outer skin, or even to provide several such lines between the outer skin and the inner shell on the same connecting element. The holes also do not have to be arranged in a linear extension, but they can absolutely also be arranged at an angle or wave-like. Substantial is that in case of forces acting from the outside onto the hull of a ship according to the invention, the rated break points in direct proximity of this force effect are excessively strained and tear open at the predetermined points, and that the inner shell is not damaged thereby, and the stability of the ship is maintained therein.

Regarding the shape of the elongated holes, it can be resorted substantially to rectangles rounded off. However, holes tapering in longitudinal direction, that is towards the perforation line, can be provided just as well. It is essential in this regard that the remaining webs between adjacent elongated holes are dimensioned such that they burst, when certain forces act upon them, wherein this breaking force has been adjusted to the destructive force to be expected of an expected collision with another ship.

Correspondingly, the brace pieces serving as support rest for the stringer metal sheets, are configured with rated cracking points such that these prevent in reaction to a destructive force that forces are transferred to the inner shell, or a substantial portion of the forces are not transferred to the inner shell or are transferred such that the inner shell is not destroyed, although it can be deformed across a relatively large area.

The core of the present invention does not only aim at the interruption of the flow of forces, but it is also about the fact that a destructive force acting from the outside onto the hull of a ship body is transferred to the inner shell such that no destruction of the inner shell besides exterior deformation of the inner shell can occur.

The invention is also not limited to double shell tank ships, but can he implemented on all double shell ships or container ships as well and causes generally that it can be ensured in the large majority of possible collision cases that the cargo cannot discharge from the hull.

The present invention relates mainly to a double shell tank ship comprising an outer skin made of steel as well as an inner shell made of steel, which are connected with each other and form the hull. Starting from 2010, the EU demands for tank ships from 5000 tdw such shells that a cavity exists each between the exterior float skin of the ship and the inner hold area.

In a known tank ship (U.S. Pat. No. 3,844,239), a metal outer skin and a liquid-tight shell inside of it are providers which is formed from an elastomeric material and correspondingly resilient.

A tank ship is known from U.S. Pat. No. 3,699,912, wherein this is also not a double shell tank ship according to the usual definition. In the known tank ship, a receptacle is located in the interior, the outwardly directed walls of which consist of two barrier parts. These two barriers, which can also be called panels, are movable towards each other and can be deformed relatively to each other in case of a collision such that the interior, in which crude oil is contained, for example, remains closed towards the outside.

The double shell structure according to JP 08230775 A comprises a typical double shell tank ship. Thus an outer skin and an inner shell are provided, between which the stringer decks are located as connecting parts. The object is now to achieve a collision stability in that the inner shell is not formed from plates, as usual in double shell tank ships, but from corrugated iron parts instead, such that in case of a collision the inner shell can expand and collision energy can be absorbed by the corrugated shape.

A known vehicle for the transport of chemicals (EP 0 723 908 A1) is not a double shell tank ship, but a vehicle comprising an outer shell, wherein a double wall construction with an inner and outer wall is provided. These two parts are interconnected by means of cross bracing elements, which also serve as partition walls. In this, the exterior connection is fixed, while the interior one has been hit such that the attachment is destroyed in case of a collision such that is cannot result in the so-called "membrane stresses" in the outer shell, and bracing parts are provided for this purpose, which can only resist a certain limited load.

The JP 07196074 A relates to a double shell tank ship, wherein, between the two walls of the exterior wall and the interior wall, parts or materials, respectively, shall be provided, which are resistant to compression, but cannot bear tensile stress. For this purpose, the outer shell is provided by a plurality of Anti-Flexure materials and horizontal binding rivets in longitudinal direction. These elements are to receive compression forces created by a collision, in order to protect the inner shell in this manner. If large deformation forces are transferred to the inner shell simultaneously via transweb parts during a collision, torsion elements mounted on both sides of each transweb part can be subject to torsion, and these finally separate from the inner shell at the corresponding strain such that this can be deformed or bend only slightly. It arises from this teaching to arrange special longitudinal structures between the shells of the tank ship, which can be loaded for pressure, but not for torsion, and to provide additionally torsion elements, which transform the forces produced by the collision into torsional forces and cause only slight deformation or bending of the inner shell in this manner. However, such a construction conditions a substantial additional effort, wherein it is questionable, whether these torsion elements can be designed such that they can manage possible collisions and the strains resulting therefrom.

A further typical double shell tank ship can be seen in the Japanese Patent Publication JP 08301180 A. An outer shell made of steel and an inner shell, also made of steel, are provided there, wherein stringers are located between these parts. In order to prevent the discharge of oil in case of a collision, a sheet steel panelling is provided on the interior of the inner shell. This panelling is in this case a thin sheet comprising a thickness of 1.5 to 3 mm, i.e. a material, which is considerably thinner than the inner shell. This steel panelling is attached by means of spacers. The philosophy of this construction is that even in case of severe destruction of the outer skin and the inner shell sufficient energy of the collision can be absorbed, and the inner shell remains in a liquid-tight state, though.

Considering the prior art as a whole, which certainly offers possible solutions for problems similar to those, on which the present invention is based, it is to be noted that it is indicated nowhere, to equip in a double shell construction of all parts the connecting elements of the outer skin and the inner shell with rated break points or perforations. It can be achieved by these rated break points or perforations that in case of a collision the deformations of the hull, which cannot be avoided, are absorbed such that deformations occur only at locations, where they do not destroy the inner shell. By the cracking of rated break points, the energy of the collision is absorbed as deformation energy. Above that, mechanical connections between the outer skin and the inner shell are interrupted such that exterior forces at least cannot act on the inner shell any more.

This invention comprises still another feature, that is the selection of the material of the inner shell, and this should be highly resilient steel with high breaking elongation. This implies that the double shell structure is not weakened in any way by the choice of this material, if the normal condition without collisions is concerned.

The invention is explained below by way of example with reference to the drawings.

Figure 1:
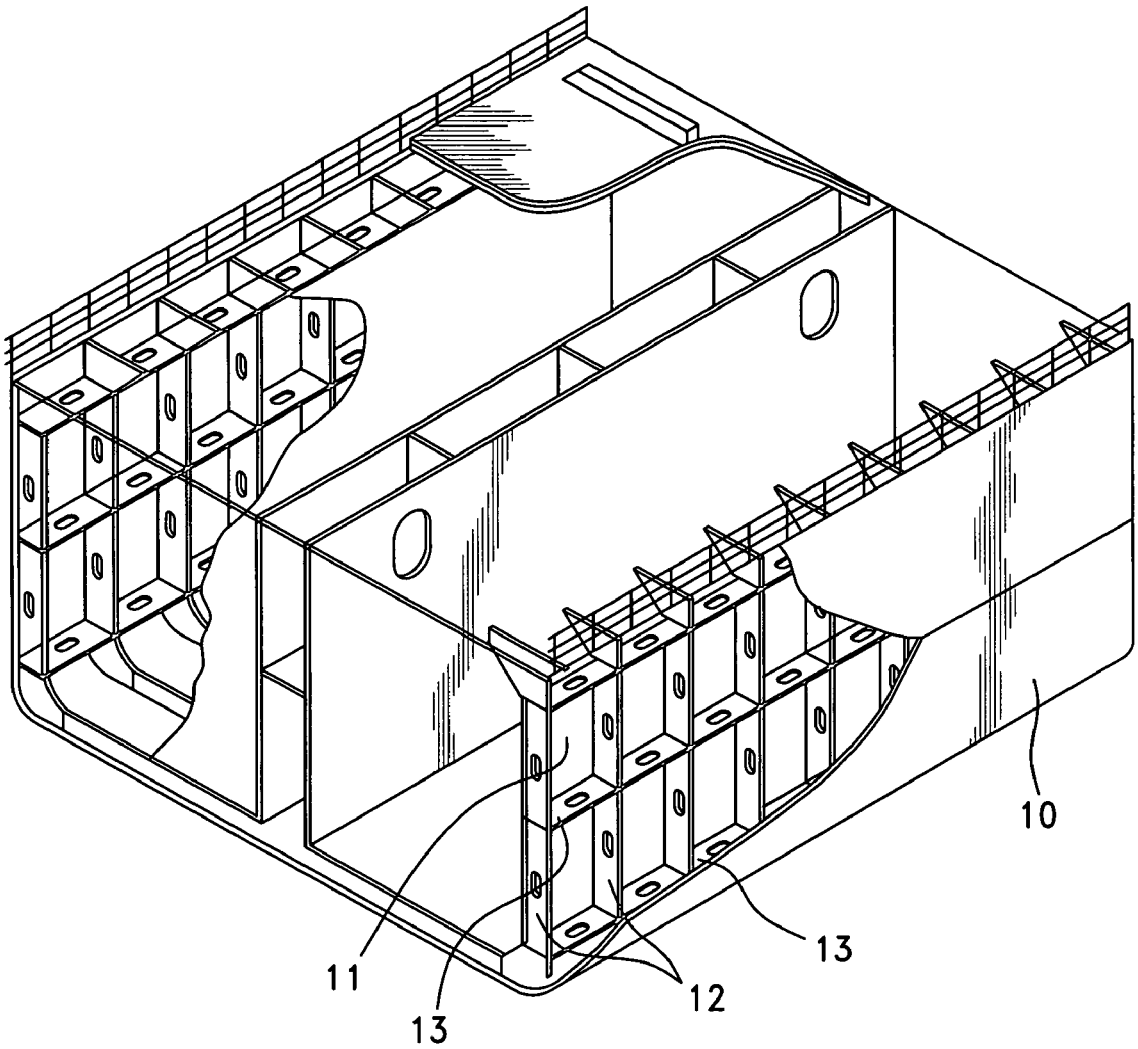
FIG. 1 shows a diagrammatic view of a part of the hull of a double shell tank ship according to the invention.

FIG. 4 allow an enlarged view of the space between the outer skin and the inner shell of a double tank ship according to the invention.

FIG. 5 shows, on an enlarged scale, perforations in a part of a stringer or a member of frame.

In the figures, the outer skin 10 of a double shell tank chip as well as the inner shell 11 can be seen. Between the outer skin 10 and the inner shell 11 there are in a honeycomb or lattice construction substantially vertically oriented members of frame or connecting elements 12 as well as substantially horizontally formed connecting elements 13, so-called stringers. The elements 10 to 13 form a rigid construction.

In the FIG. 4 illustrated on a larger scale, the horizontal connecting elements 13 and the vertical connecting elements 12 can be seen. The outer skin has been omitted in this illustration, but the inner shell 11 can be recognised. The FIG. 4 shows the conditions after a collision and clarifies, how rated break points 20 due to the locally prevailing forces have reacted such that the inner shell 11 has been deformed, but not in the same manner as the deformation of the outer skin, not shown, or of the connecting elements 12 and 13, respectively.

It can be taken from FIG. 4 as well that the inner shell 11 has been softly deformed, without a break being developed. There are steels, which are suitable for such a strain and in particular have a high breaking elongation.

FIG. 5 shows three adjacently located recesses in a part of the connecting elements 12 or 13, respectively. Three elongated holes 20 in one row can he seen, wherein the mutual distances have been chosen such that they tear open at the respective strain. The shape of the elongated holes has been chosen deviating from a rectangle or a round hole rounded off such that the desired tearing open in a perforation line can be ensured.

Figure 2:
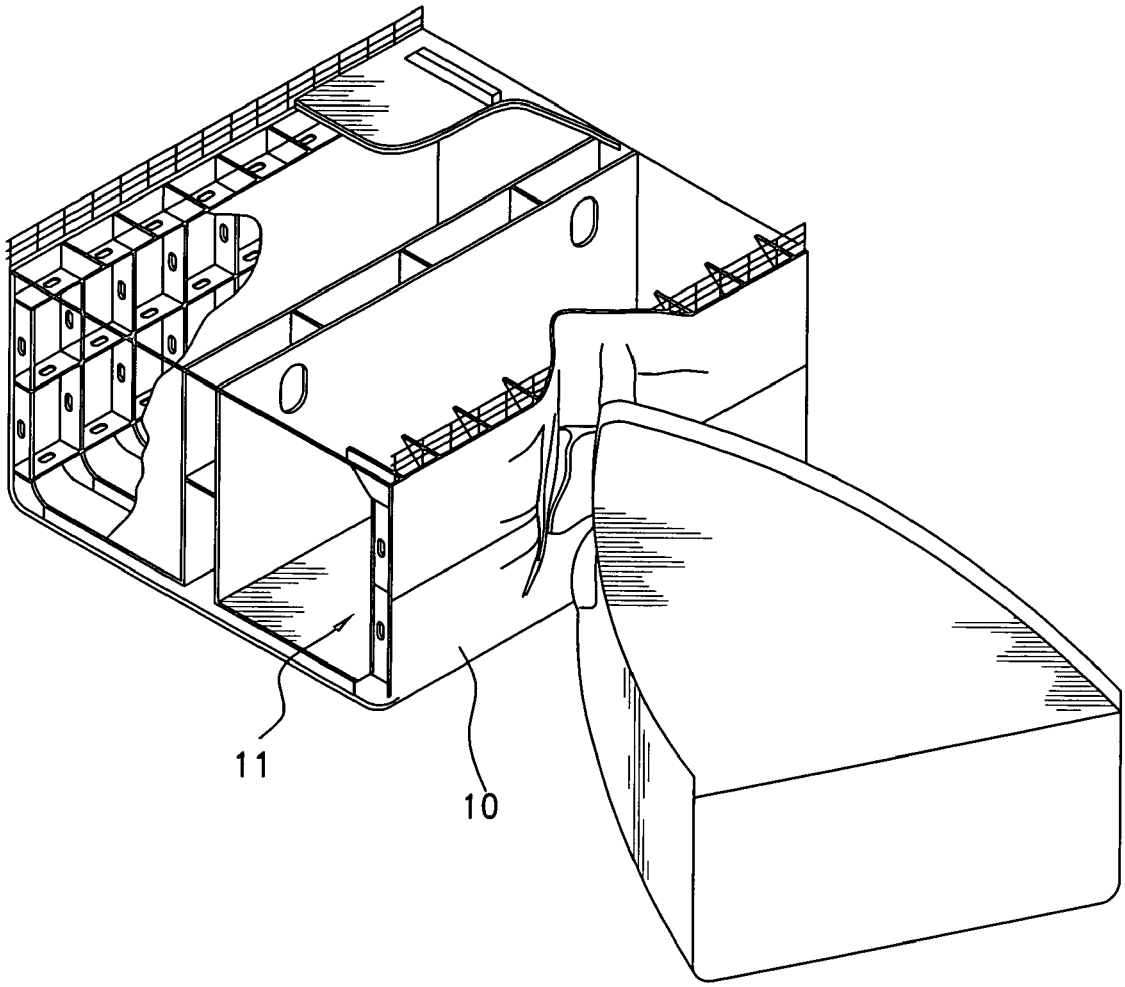
FIG. 2 shows a corresponding view and illustrates the conditions in an average case.
Figure 3:
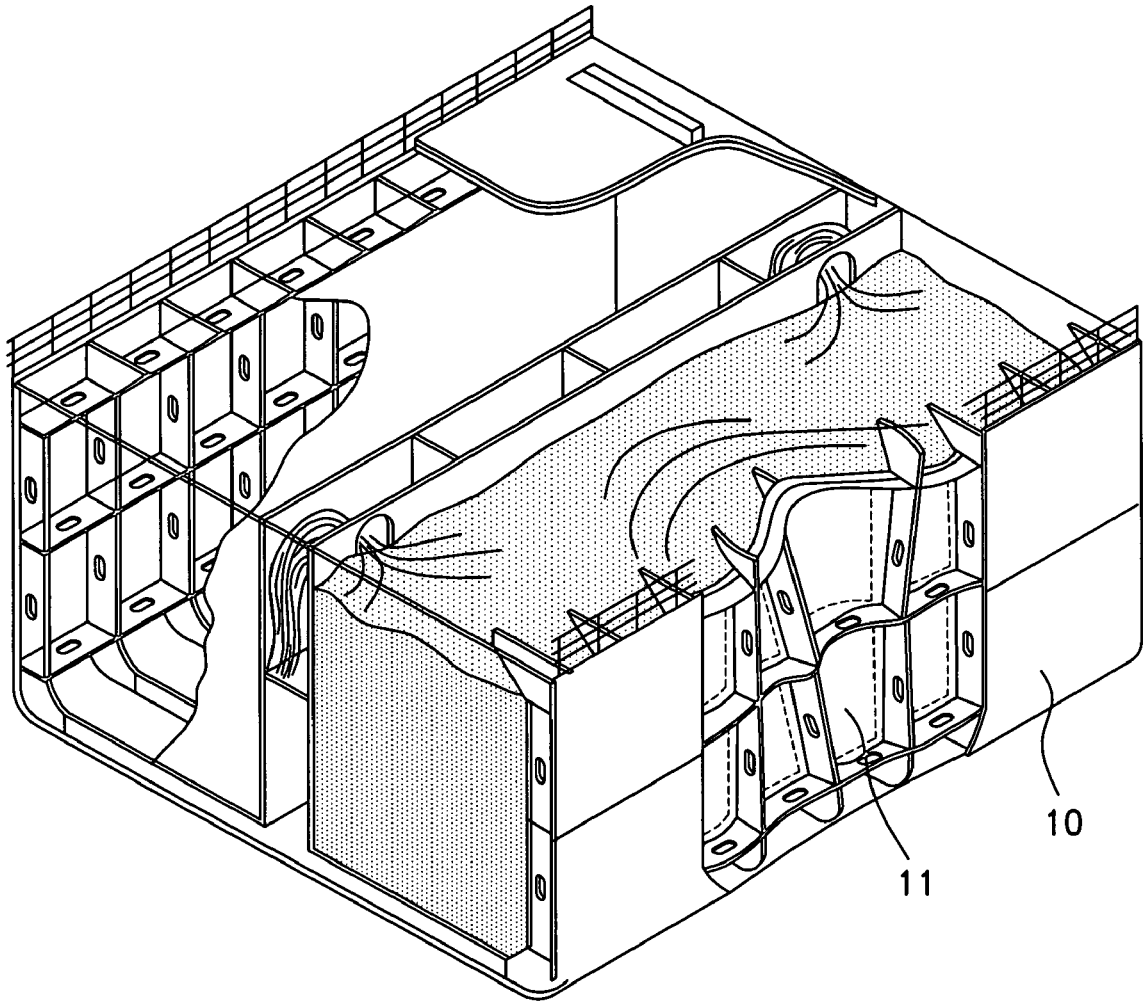
FIG. 3 shows, as, an example, the damage created at the hull after an average.

It is within the scope of the present invention to ensure in case of an average with not completely filled holds (usually the filling degree is 97%) that the interior of the hold, which is reduced by the deformation, can be deformed such that the cargo can escape through bursting plates into the area of the double central longitudinal bulkhead, as shown in the FIGS. 1 to 3.

The invention claimed is:

1. A double shell tank ship comprising an outer skin, and an inner shell surrounding individual holds and spaced from the outer skin, wherein the outer skin and the inner shell are rigidly interconnected by substantially vertically and horizontally extending connecting elements, characterized in that at least some of the connecting elements (12, 13) are provided with rated break points (20) that tear open upon the imposition of a force on the double shell tank ship that is less than a force that would deform the inner shell, whereby deformation of the inner shell is reduced or prevented, and the inner shell (11) is made of a steel having a breaking elongation high enough to enable the inner shell to deform without developing a break in most ship collisions.

2. A double shell tank ship according to claim 1, characterized in that the rated break points (20) are in at least some of the vertically extending connecting elements (12), and the rated break points in the vertically extending connecting elements are close to the inner shell.

3. A double shell tank ship according to claim 2, characterized in that the rated break points (20) are in at least some of the horizontally extending connecting elements (13), and the rated break points in the horizontally extending connecting elements are close to the inner shell.

4. A double shell tank ship according to claim 3, characterized in that the rated break points comprise rows of round holes.

5. A double shell tank ship according to claim 3, characterized in that the rated break points comprise perforations.

6. A double shell tank ship according to claim 2, characterized in that the rated break points comprise rows of round holes.

7. A double shell tank ship according to claim 2, characterized in that the rated break points comprise perforations.

8. A double shell tank ship according to claim 1, characterized in that the rated break points (20) are at least some of in the horizontally extending connecting elements (13), and the rated break points in the horizontally extending connecting elements are close to the inner shell.

9. A double shell tank ship according to claim 8, characterized in that the rated break points comprise rows of round holes.

10. A double shell tank ship according to claim 8, characterized in that the rated break points comprise perforations.

11. A double shell tank ship according to claim 1, characterized in that the rated break points comprise of rows round holes.

12. A double shell tank ship according to claim 1, characterized in that the rated break points comprise perforations.

* * * * *